US006672582B2

(12) United States Patent
Dittli et al.

(10) Patent No.: US 6,672,582 B2
(45) Date of Patent: Jan. 6, 2004

(54) DELIVERY AND EJECTION DEVICE FOR FLAT ELEMENTS INTO A MACHINE WORKING THEM

(75) Inventors: Oskar Dittli, Lausanne (CH); Pierre Robadey, Pompaples (CH); Michel Mermet, Echallens (CH)

(73) Assignee: Bobst S.A. (CH)

( * ) Notice: Subject to any disclaimer, the term of this patent is extended or adjusted under 35 U.S.C. 154(b) by 178 days.

(21) Appl. No.: 10/017,063

(22) Filed: Dec. 14, 2001

(65) Prior Publication Data

US 2002/0101031 A1 Aug. 1, 2002

(30) Foreign Application Priority Data

Dec. 14, 2000 (CH) ..... 2000 2439/00

(51) Int. Cl.[7] ..... B65H 31/20

(52) U.S. Cl. ..... 271/182; 271/202; 414/789; 198/594; 198/812; 198/347.4; 198/418.6

(58) Field of Search ..... 271/182, 202, 271/203; 414/789, 790.6, 790.7, 793.4, 793.5; 198/579, 594, 606, 812, 837, 347.4, 418.6, 419.2

(56) References Cited

FOREIGN PATENT DOCUMENTS

| | | | |
|---|---|---|---|
| CH | 633761 | A5 | 3/1982 |
| EP | 0316477 | A1 | 11/1987 |
| EP | 0317330 | A1 | 11/1988 |
| GB | 2074990 | A | 11/1981 |

*Primary Examiner*—Douglas Hess
(74) *Attorney, Agent, or Firm*—Ostrolenk, Faber, Gerb & Soffen, LLP

(57) ABSTRACT

A device for stacking sheets delivered on a first conveyor in a plurality of parallel streams of overlapping sheets, includes a second conveyor moving slower than the first conveyor that compacts the streams as they exit the first conveyor; a third conveyor that receives the streams from the second conveyor; and a plurality of stackers, each aligned with one of the streams exiting the third conveyor, formed of endless belts positionable horizontally which cooperate with stop members to stack the incoming sheets. Completed stacks are then moved downstream on the belt. When sheets in a stream are determined to be defective; its belt for that stream is tilted, and the stream falls onto a fourth conveyor for disposal. A spacer introduces spacing into each stream to delineate portions of the streams which will form successive stacks, includes adjusting devices that lengthen and shorten the second and third conveyors, and a device selectively operable to stop passage of the streams from the second conveyor to the third conveyor. The adjusting devices are coupled to simultaneously lengthen one of the conveyors and to shorten the other conveyor. A drive mechanism for the third conveyor moves the third conveyor at the same speed as the second conveyor receiving the streams from the second conveyor, and faster than the second conveyor when delineated portions of the streams are being delivered to the stackers.

19 Claims, 5 Drawing Sheets

DELIVERY AND EJECTION DEVICE FOR FLAT ELEMENTS INTO A MACHINE WORKING THEM

Figure 1:
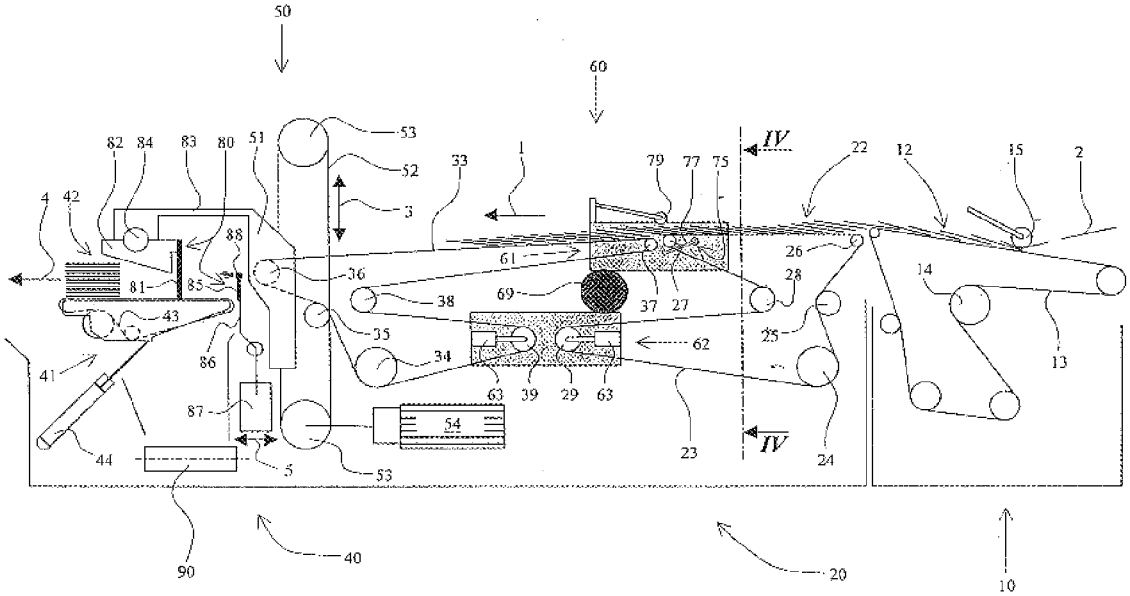

The present invention has as an aim a delivery and ejection device for flat elements into a machine working them, in particular into a packaging production machine intended for the manufacturing of cardboard boxes from a web or sheet material.

Such machines include several stations the ones followed by the others, typically allowing to print the used material, to cut it out according to a reference shape by means of a rotary tool for example, then to reject, on one hand, the inconvenient waste resulting from cutting and, on the other hand, all unsuitable blanks before collecting the other boxes blanks into a delivery station.

The subject of the invention is useful in this last operation. The worked sheets or cardboard web can generally include in their width several identical boxes blanks or cuttings, each one representing the shape and the developed surface of the manufactured packaging. The amount of blanks which can be thus laid out side by side depends of course on the width of the worked support, but also on the maximum suitable format for the machine and on the size of the boxes blanks.

Once achieved, these boxes blanks are laid out, into the delivery station, in parallel lines of streams on conveyor belts. This shingling, that is to say that blanks overlap one another, is due to the fact that the conveyor belts are moving more slowly than the feeding sheets or cardboard web. There are thus as much streams rows as much blanks in the width of the worked support. The streams are then regularly collected by a stacker forming piles which will finally be delivered on a carriage or, by another belt conveyor, towards a storage station for example.

Documents EP 316'477 and EP 317'330 describe similar devices which allow the quick stacking of the downwards part of a single stream of flat elements so as to be piled up. These shingling and sheets stacking devices are working continuously without needing to stop the shingling operation during the pile removal. To do so, these devices include two overlapping conveyors with parallel belts so that the second conveyor is settled onto the longitudinal axis of the first one and can slightly go up and down through the latter. Initially, the two conveyors are moved at the same speed. When the leading part of the stream includes enough sheets to make a pile of several of them, the second conveyor raises itself slightly above the plan of the first one and carries, at high speed, the corresponding stream part to deliver it onto a plate against a stop along which the aforementioned pile will take place. Initially settled in high position, this plate goes down progressively according to the sheets stacking so that the falling height of the sheets is constant in order to ensure a good stacking. The sheets pile must then be lowered until an output level where it will be removed from the plate before this last one can raise again to be able to deliver the next pile of sheets. Meanwhile, the second conveyor was lowered and replaced in its initial position under the new leading edge of the stream which was continuously travelling thanks to the regular drive of the first conveyor. A new operating time can thus start again. The operations intended for the pile formation, its removal from the plate and the raising again of this latter in its initial position must of course succeed quickly enough to avoid, in all cases, the new edge of the stream to be almost engaged and to fall too early from the first conveyor.

Another device intended to form piles of sheets starting from shingling elements is described in the document CH 633'761. It includes several conveyors, each one comprising a rolling conveyor belt arranged into the whole width of the machine. On this width, several parallel shingle stream of blanks can fit here. This device also allows to receive and pile up boxes blanks without decreasing the machine production rate which is secured to it thanks to a braking device which will stop the run of the streams. This stop will temporarily increase the thickness of the streams. The last conveyor belt is settled so that it can turn around its control shaft, which allows, if necessary, to have the streams path deviated onto another waste removal conveyor belt. This path deviation occurs if imperfections in the printing or in the manufacturing of the boxes blanks would have been scanned by control devices located upstream. The piles of each stream are then simultaneously arranged onto a carriage movable into vertical direction, then moved by a push rod onto a transverse conveyor which will remove them.

One disadvantage of this device finds its way by the stripping of the imperfectly printed blanks which must be driven out of the normal path. Depending on the nature and on the origin of the defects, one specifies that the latter can of course modify only one row of blanks, when ignoring the other rows simultaneously produced. However, in this device, the report of a defect on one part of an unspecified stream means not only the stripping of this latter but also the stripping of all other adjacent stream parts which are simultaneously onto the same conveyor belt. It generates a waste, of course undesirable, which can become proportionally significant, especially when carrying out small production series.

The document GB 2'074'990 describes another device allowing the delivery of a certain amount of sheets starting from a stream travelling continuously through a delivery station. As it is the case for almost all delivery devices, it is necessary to enter a stop in the continuous flood of the sheets stream in order to handle with a minimum necessary time for the stripping of the pile and for the replacement of the means used to deliver the next pile. To this end, the device as described in document GB 2'074'990 is made of two en to end telescopic conveyors. Each conveyor is made of an endless belt set into rotation around a plurality of tracks or rollers. The rotation speeds of these belts are interdependent the one from the others. The front end of the first conveyor and the back end of the second conveyor, which faces it, are assembled onto a same carriage which can move longitudinally forwards to backwards into the moving direction of the stream. When the stacking is almost achieved, one must deal with a stop in the stream moved by these two conveyors. To do so, the aforementioned carriage moves towards downstream and the speed of the second conveyor is increased in order to release quickly the second conveyor from its loading and to generate thus a sufficient lack of time allowing the stripping of the pile. Once the delivery support is ready to receive a new pile, the speed of the second conveyor is reduced and the carriage goes back upstream in its initial position.

Although it is running with satisfaction, this device suffers from a first defect related to the carriage size which is necessary dependent from the length of its run. Indeed, as it is performed for this invention, one can note that the length of the carriage must be in all cases more important than the maximum length of its moving. However, if one wants to reach higher production rates, it is also necessary to increase the run of the movable carriage, which means in fact to have to perform with a carriage the more longer and the more imposing. Another defect of this device results from the repeated moving of the carriage. To be able to perform the longest possible stop of the stream, it is necessary to get the carriage back as quickly as possible. However, being at evidence of a relatively large size, this carriage represents also a significant moving entity which, on one hand, requires a powerful moving mechanism and then a braking mechanism which, on the other hand, must be controlled by a massive surrounding carrying structure. Moreover, the inertia strength of this carriage continuously generates strong shocks into the machine frame. The whole range of these undesirable requests and mechanical constraints are dealing with a heavy, cumbersome and expensive equipment.

All these devices also show another disadvantage which finds its way by the stacking. This operation needs a support, movable in the vertical plan, which successively goes from a high initial position, when it is empty and ready to receive a new pile, to a low output position allowing the side unloading of the pile. Although this way of doing is reliable and works well, it needs however a whole range of operations which can only be sequentially carried out. As it seems at first to be impossible to reduce much more the useful time to carry out each separate operation, it is also impossible to reduce the total time needed to discharge the pile and to raise up again the support in its initial position, considering that the support can be raised up again only once the pile is discharged.

Another disadvantage is due to the fact that these devices, either do simply not allow to reject sheets of insufficient quality, or excessively extend this operation to a whole range of the production by eliminating all the sheets within the width of the machine. To carry out this stripping operation, another more accurate solution consists in rejecting the sheets of bad quality one by one, in a quality controlling and stripping device before these ones are shingling. However, located into the production line upstream from the delivery station, such a device is, on one hand, not intended for the stripping of already shingling sheets and, on the other hand, means an additional module for the production line, which is completely dissociated and different from the object of the present invention.

The present invention has as an aim to deal with the above mentioned disadvantages by providing a delivery and ejection device for flat elements which is fast, economic, universal and easy to deal with. With the wording economic, one will understand that this device has to be manufactured at low cost, but must also avoid any kind of waste while quickly sorting the parts which are comprised within the quality standards from those with defects having to be rejected from the production line. With the wording universal, one intends to provide a device which can suit at the same time with a whole range of goods of different formats and ensure an easy way to deal with so as to work with each one of these products while reducing as much as possible the settling operations of the delivery device between two series of different works. Thus, the object of this invention must be easily adaptable so as to deliver as well wide boxes blanks, such as for example 1 or 2 blanks in the whole width of the machine, as smaller boxes blanks numerously divided (for example 10) into the width of the machine. This device must also be able to reject quickly and with less wasting all boxes blanks which are not included within the required quality standards. One will note that to effectively suit this last speed condition, it is at this point already impossible to think of carrying out such a sorting sheet after sheet before the latter are shingling.

To this end, the present invention has as an aim a delivery and ejection device in conformity with what is stated in claim 1.

Figure 2:
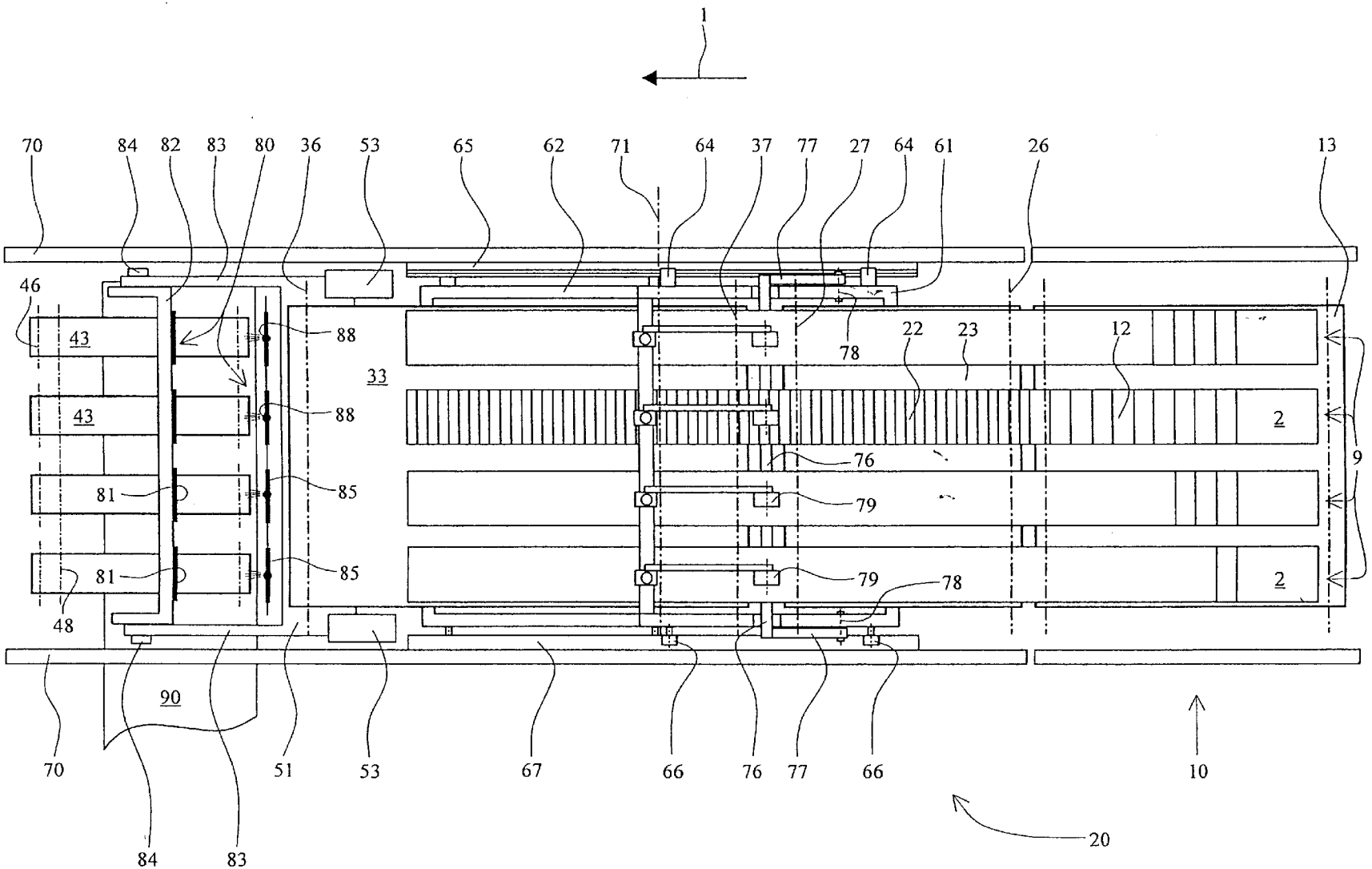
Figure 3:
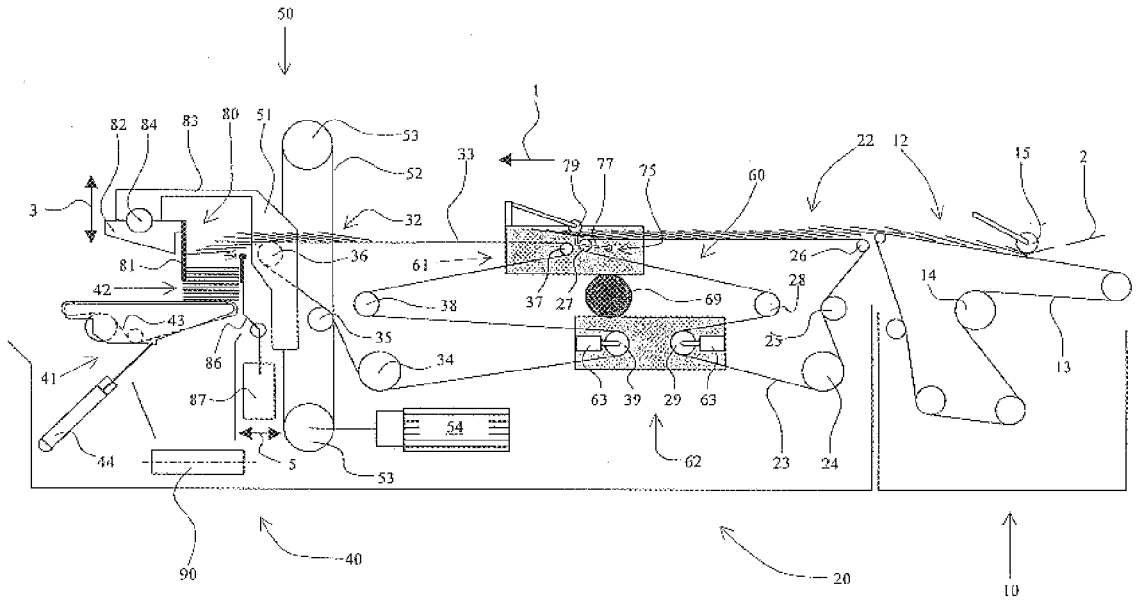
Figure 4:
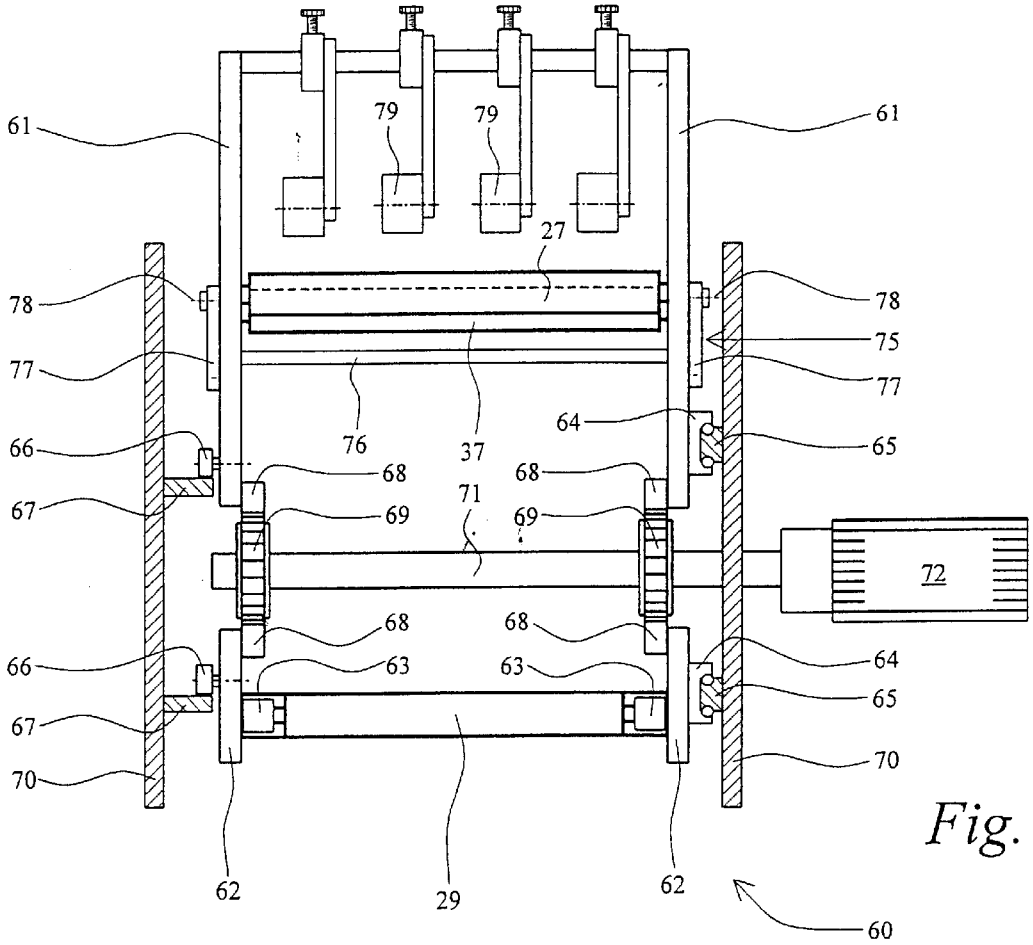
Figure 5:
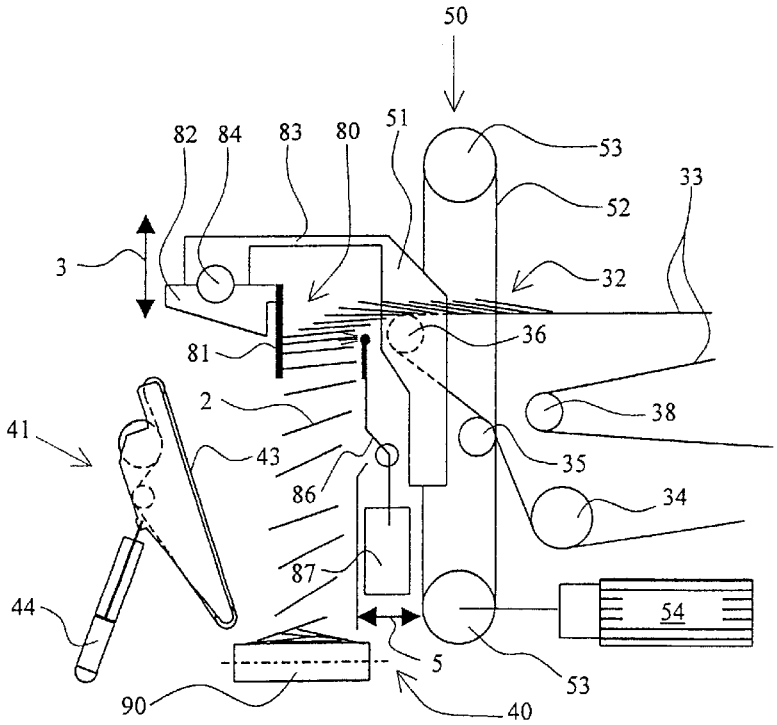
Figure 6:
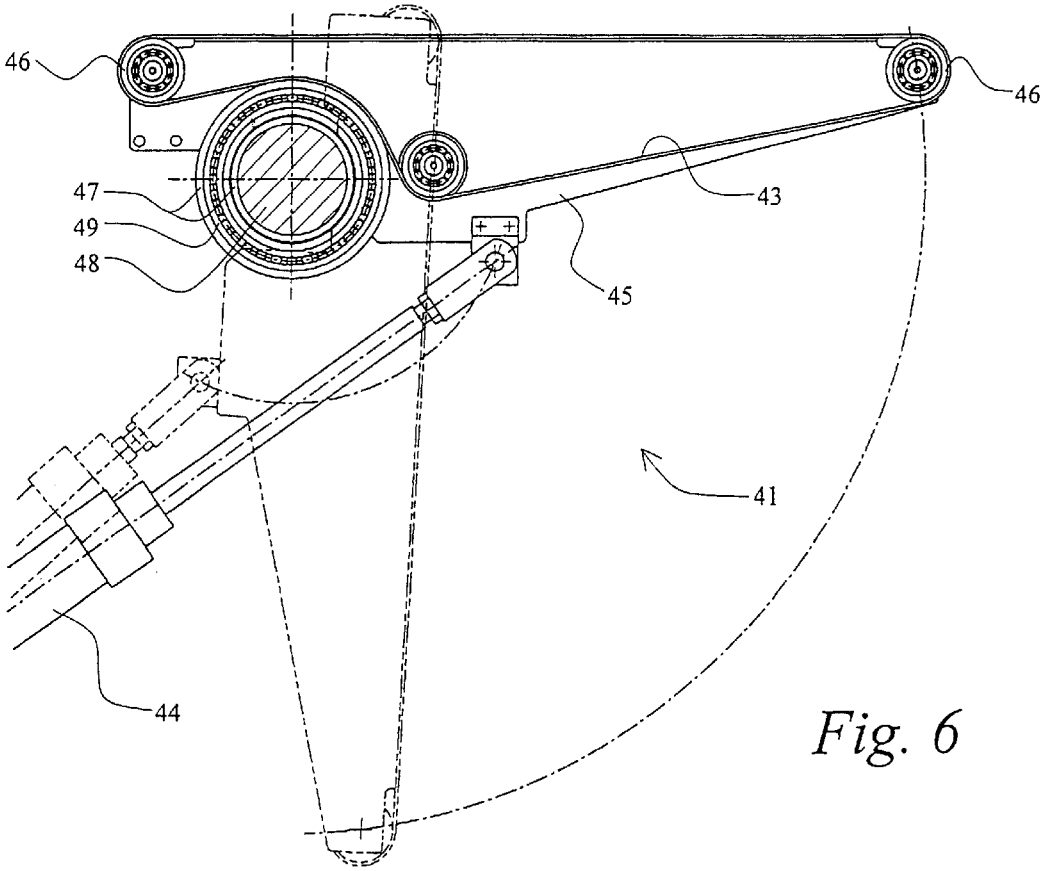
Figure 7:
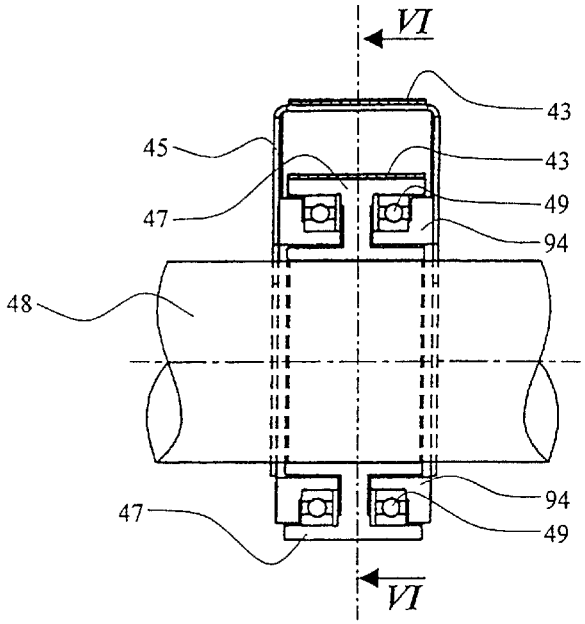

The invention will be more readily understood from one embodiment without limiting force and illustrated in the accompanying figures wherein FIG. 1 represents a schematic front view of the device according to the invention in a first situation, FIG. 2 represents a simplified schematic plan view of the device as shown on FIG. 1, FIG. 3 represents a schematic front view of the device according to the invention in a second situation, FIG. 4 represents a schematic sectional view, according to the line IV—IV of FIG. 1, of a part of the driving mechanism of the device according to the invention, FIG. 5 represents the downstream part of the device of the invention in a different situation than the one illustrated on FIGS. 1 and 3, FIG. 6 represents a partial sectional profile view, according to the line VI—VI of FIG. 7, of an output ramp of piles of sheets, FIG. 7 represents a detailed partial sectional view of the output track illustrated on FIG. 6.

In order to define some wording usually used in the following description of the orientation or the localization of some parts of embodiments, one will note that the words "longitudinal" and "transverse" always deal with the main run axis of flat elements into the machine, and that the words "upstream" and "downstream" respectively mean the side which is right next to the machine input and the one which is right next to the machine output.

FIG. 1 represents a schematic front view of a device 20 for delivery and ejection of flat elements, such as cardboard sheets 2, in a first situation illustrating the moving of a stream 22 of sheets 2 from upstream to downstream in the longitudinal direction of the machine according to the way of run shown by arrow 1. For practical reasons issued from use tests, a very tight stream of sheets, such-as stream 22 in device 20, cannot be directly assembled starting from sheets 2 travelling the ones after the others at very high speed. Thus, the delivery device 20 must first of all be preceded by a unit 10 comprising a first stream 12 of sheets 2, more spaced than those of stream 22, between a conveying belt 13 moved at reduced speed by a driving roller 14 and a range of pressure rollers 15 pressing and slowing down sheets 2 against the conveying belt 13 when they arrive and shingle at high speed into the unit 10.

The stream 22 is achieved on a second conveying belt 23 comprised in the delivery and ejection device 20 of sheets 2. This conveyor belt 23 fills, as well as all conveying belts of this device, the whole width of the machine. It is actuated by a driving roller 24 which makes it turn, at a lower speed than the one of the conveying belt 13, around a plurality of rollers or idling rollers 25, 26, 27, 28 and 29.

Driven into the direction shown by arrow 1, the stream 22 travels then on a third conveyor belt 33 put into rotation by another driving roller 34 which is, as well as the other driving means, completely interdependent. The conveyor belt 33 turns, into the direction of arrows 1, around other rollers or idling rollers 35, 36, 37, 38 and 39.

After the conveyor belt 33 a stacker 40 collects the stream sheets 2 on a plurality of tracks 41, adjustable in the width of the machine, so as to form a pile 42 which, as illustrated on FIG. 1, will be finally rejected out of device 20 and of stacker 40 in the direction of arrow 4 by one or more belts 43 provided on each track 41. The stacking of sheets 2 is carried out on the tracks 41 by displacement of the downstream end of the conveyor belt 33 in the vertical plane so that the height of the falling down of sheets 2 onto the top of the pile is constant. To this end, the roller 36 is interdependent from a lifting platform 50 made up of a frame 51 vertically movable as illustrated by the double arrow 3. This frame 51 is secured, on each side, to a chain 52 suspended by sprockets 53. The drive of the chain is achieved by means of an engine 54 coupled to one of the sprockets 53.

FIG. 2 shows a simplified schematic plan view of the device as shown on FIG. 1. On this second fig., four illustrated parallel lines 9 of sheets streams are progressing into the direction of arrow 1 of the first conveyor belt 13 towards the other conveyor belts 23 and 33 before stacking distinctly on belts 43 of tracks 41. To improve the readability of this figure and to avoid its overloading, only one line 9 of shingling sheets was completely drawn. Only the shapes of the three other lines are to be seen. Moreover, the idling rollers of the ends of the conveyor belts are removed and shown here only by their axis in dotted lines. In the following description--and in order to simplify the explanations, one will usually deal with the course and the description of the sequences of only one line 9 of shingling sheets. Hence, it is of course accurate to keep in mind that the same operations are carried out simultaneously and in synchronism onto all the sheets lines travelling towards the conveyor belt 33, whatever the number of these lines is.

FIG. 3 shows, in a similar way than on FIG. 1, the device according to the invention in a second different way from the one illustrated on FIG. 1. The drawings of these two FIGS. 1 and 3 will allow to better understand the operating way of the device of the invention which will be described at present. One of the aims stated in all up to date delivery devices consists in being able to have piles of a certain amount of sheets without having to stop the continuous production flood of the sheets delivered upstream by the printing machine. In this presentation, the continuous production of sheets 2 is illustrated by the unit 10 which creates continuously the movable stream 12. On the conveying belt 23, this latter is simply tightened into a stream 22 by means of lowering the conveying speed. As this production flood is continuous, it is necessary to enter a stop in this stream 22 which allows to save the useful time, particularly to form the corresponding pile of sheets 42, to reject this pile out of the stacker 40 and simultaneously replace the stacker parts in a new initial position ready for the delivery of the next pile. To do so, the device of the present invention is equipped with a driving mechanism 60 and a streams stopping mechanism which allows-to vary the useful lengths of the conveying belts 23 and 33. This mechanism is located, in device 20, in the middle, between the conveying belts 23 and 33. It comprises two carriages, an upper one 61 and a lower one 62, which can move horizontally from upstream towards downstream and inversely. The moving of these two carriages is completely interdependent the one from another so that the speed of one of the carriage is always similar to the speed of the other one and that their moving direction is always in opposition. Such a device is ensured thanks to the engaging of toothed racks, secured to said carriages, onto a pair of toothed wheels turning alternatively into a direction then into another, as described with more details hereafter.

FIG. 4, illustrating a vertical cut according to line IV—IV of FIG. 1, allows to better understand the functioning and the layout of the driving device 60 located between the two main elements which constitute the frame 70 of device 20. To allow the reading of this fig., one will note that the conveying belts and the sheets streams were not represented. In the upper carriage 61, the idling rollers 27 and 37 are free rolling and settled between the vertical sides of this carriage. The lower carriage 62 itself holds the idling rollers 29 and 39. The latter are themselves free rolling and settled on a pair of pneumatic jacks 63 which are fixed against the interior sides of carriage 62. The layout of these jacks allows to compensate in a independent way lacks of tension which appear in the conveying belts 23 and 33 when the carriages 61 and 62 are moving. Although the latter relocate simultaneously the two pairs of rollers 27, 37 and 29, 39 of a same length in an opposite direction, the lengthening or the shortening of the higher part of the conveying belt 33, for example, between the rollers 36 and 37 cannot be completely compensated by the shortening, respectively the lengthening, of its lower part between the rollers 38 and 39. This fact results from the geometrical location of the rollers 36, 37, 38 and 39 which are showing two unequal angles of opposite edges represented by the rollers 37 and 38. So, the unequal lengths variations of the conveying belts between these rollers have to be compensated at any time by the moving of the roller 29 actuated by one of the pairs of jacks 63. The same applies to the conveying belt 23 and to the rollers 26, 27, 28 and 29.

The carriages 61 and 62 slide between the frame 70, for one side by means of jaws equipped with balls 64 secured against one of the panels of the carriages and slipping each one along a rail 65 interdependent from the aforesaid frame, and for the other side by means of rollers 66 secured against the other panel of carriages 61, 62 and travelling each one on a running tread 67 secured to frame 70. The driving of the carriages is carried out by the engaging of toothed racks 68, secured against the interior panels of the carriages, in the lower part for the carriage 61 and in the higher part for the carriage 62, with a pair of toothed wheels 69 settled on shaft 71 of an electric engine 72. Speeds and accelerations of carriages 61 and 62 can thus be precisely controlled thanks to the control flexibility of the electric engine 72. Moreover, one will ensure as well as possible the load balances of these two carriages in order to compensate the dynamic effects generated when the latter are moving.

In order to create a sharp and precise separation of stream 22, a grip 75 shuts up on this stream between the rollers 27 and 37 of respective conveying belts 23, 33. This grip is made of a transverse bar 76 settled at the ends of the two parallel bent arms 77 and wheeling around a rotation axis 78 crossing the upper carriage 61. To grip the stream 22, the two bent arms 77 are wheeling upwards and the transverse bar 76 compresses the stream against a series of support rollers 79 laid out according to one's wishes over the stream 22 between the rollers 27 and 37.

In a situation initially represented on FIG. 1, the conveying belts 23 and 33 have both a constant identical speed so that the travelling of stream 22 of the conveying belt 23 towards the conveying belt 33 is not noticed. When the number of sheets required for a pile is to be found on the conveying belt 33, the driving mechanism 60 of the carriages 61 and 62 is actuated and involves progressively the downstream and upstream ends of the respective conveying belts 23 and 33 into the direction of arrow 1 until the moving speed is identical to the running speed of the conveying belt 23. At this time, the grip 75 shuts up on the conveying belt 22, then the speed of the conveying belt 33 fastens quickly and creates thus the separation of the stream 22 of which the downstream part 32 comes to flow fast into the stacker 40 as illustrated on FIG. 3. During this operation, the roller 36 of the downstream end of the conveying belt 33 is vertically moved upwards by the elevator 50 so that the drop height of sheets 2 on the top of the forming pile 42 is at any time constant and optimal. Meanwhile, the carriages 61 and 62 did not stop moving, towards downstream for the carriage 61 and upstream for the carriage 62, at the same speed than the conveying belt 23 while following the continuous progression of the stream 22. In order to make sure that the whole stream 32 left the conveying belt 33 the high flowing speed of this conveying belt is still maintained for a couple of fractions of seconds after the theoretical flowing of the last sheet of stream 32. Then this speed decelerates until it is identical again to the one of the conveying belt 23. At this time the grip 75 opens, releasing the progression of stream 22 on the conveying belt 33, and the driving of carriages 61 and 62 is gradually slowed down until being reversed for getting the carriages back in their initial respective position. Just after the theoretical flowing of the last sheet of stream 32 on the pile 42, this pile can be immediately evacuated by the actuation of the belt 43 which carries it towards one of the outputs of the machine. As soon as possible, but even before the carriages 61, 62 are back into their initial position or before the pile has entirely left the slope 41, the elevator 50 goes down again while still actuating the downstream end of the conveying belt 33 which gets back in its low position. A new cycle can then start again.

During the stacking phase of sheets 2 of stream 32, the tracks 41 are generally laid out in a horizontal normal position allowing the delivery of these sheets. One will point out here that there are as many piles 42 than there are lines 9 of streams on the conveying belt 33 which, simultaneously, are assembled on the belts 43 of parallel tracks 41. However, if a printing defect was scanned for example on the sheets of one or the other of these lines 9, one or the tracks 41 intended to this line of defect sheets can be swiveled downwards by one or several pneumatic jacks 44, even before the beginning of the sheets stacking. Thus, only the stream 32 of the line which contains defect sheets will be directly delivered from the stacker onto a reject evacuation belt 90 placed transversely according to the streams travelling. This situation is illustrated on FIG. 5 where only the downstream part of the device of this invention is shown.

FIGS. 6 and 7 show within details the mechanism which allows at the same time the wheeling of one of the track 41 and the driving into rotation of its belt 43. FIG. 6 is a partial sectional profile view of this same track 41 according to the cutting line VI—VI of FIG. 7. The illustration of FIG. 6 shows the track 41 in two different positions, one horizontal in continuous feature, and the other vertical or downwards wheeled in mixed feature. This track is made of a reversed U-shaped plate 45, as it is better shown on FIG. 7. On this plate are secured rollers 46, assembled on rotation free ball bearings, around which the belt 43 is travelling. This belt is permanently secured to a ring 47 positioned and settled on an expansible driving shaft 48 whose diameter can increase, allowing thus to firmly maintain the aforementioned ring 47. When the expansible shaft 48 is set into rotation, it actuates also the ring 47 which, by contact, makes the belt 43 turning around. In order to allow simultaneously the downwards swing of the track 41 by the jack 44, a ball bearing 49 is assembled on each side of the ring 47, on a flange 94, in a groove afforded on each panel of this ring. One part of this ball bearing 49 is interdependent from the ring 47, whereas the other part, attached to the flange 94 of this same ball bearing is interdependent only from the plate 45 which constitutes the frame of the track 41. Thanks to this functioning of this ball bearing and thanks to its layout as above described, the plate 45 can then be wheeled downwards or upwards through the jack 44 in a completely independent way from the rotation of belt 43 and its driving system.

To reach a good stacking of sheets 2 on the belts 43 of tracks 41, a transverse jogger 80 is settled into the stacker 40 and allows to longitudinally align the sheets of pile 42 against front stops 81. When they leave the conveying belt 33, the sheets are projected in their fall against the aforementioned front stops 81. Each stop is secured against the upstream side of a carriage 82 assembled between two side arms 83 of frame 51. To be able to adjust these front stops according to the format of sheets 2, the carriage 82 is movable into the travelling direction of the streams by means of a wheel 84. Each stop 81 is movable and also transversely removable so that it can be correctly positioned in front of the pile which is intended to it. Moreover, each front stop can be equipped with a template, or a shaped element not shown here, allowing to fit as well as possible the shape of the front edge of sheets 2 to be aligned. In the upstream part of the transverse jogger 80 is one or more back stops 85 actuated by a periodic movement oscillating into the direction shown by the double arrow 5 on FIG. 1. Such an oscillation can be reached for example starting from a eccentric arm 86 related to the axis of an engine 87. This vibratory back and forth motion allows to unceasingly arrange the sheets 2 when they pile up, by constraining them to pile up correctly against the front stops 81. The back stops 85 can of course also be equipped with shaped templates and can also be transversely moved just like the front stops. To carry out the transversal alignment of the sheets piles a second jogger device, not shown here but intended to act in a same way, is generally used. However, a specificity of the first jogger device 80 lies in the fact that it is equipped with a plurality of nozzles 88 insufflating air under the sheets 2 during their fall. These air blasts ensure the good piling of piles 42 by preventing the sheets from turning over or from falling under a too strong attacking angle. The air blasts strength, their amount, their position and the orientation of the nozzles are as many easily adjustable parameters selected according to the size of the delivered sheets and to their basis weight. One will also mention that such jogger devices are removable and easily adaptable to the various works to deal with allowing, when one has at least two pairs of them, to prepare them before out of the machine by fitting them for the next work.

Thanks to the device which was now entirely described, one will note that, on one hand, the travelling of elevator 50 depends only on the height of pile 42 and that, on the other hand, without taking into account the real maximum speeds which can be reached by the elevator 50 and by the stripping belt 43, the minimum necessary waiting time before being able to remove the elevator in its initial position depends only on the height and on the longitudinal dimension of this same pile 42. Thus, the moving back into low position of the elevator 50 and of the end of the conveying belt 33 can advantageously be carried out as soon as the upstream side of pile 42 has been travelling under the front stop 81 of jogger 80, thus even before this pile did leave the track 51 on which it was secured.

Many improvements can be brought to the device of this invention within the framework of the claims.

What is claimed is:

1. A delivery and ejection device for receiving flat elements from a production machine which produces a plurality of parallel streams of flat elements exiting the machine on a first conveyor moving at a first speed, with the elements in each stream arranged in an overlapping, shingled configuration, the device comprising:

a second conveyor moving at a second speed which is slower than the first speed, the second conveyor being positioned to receive the streams from the first conveyor, and as a consequence of the speed difference, to cause an increased overlap of the flat elements in each stream, whereby the streams become compacted as they pass onto the second conveyor;

a third conveyor positioned to receive the compacted streams from the second conveyor;

a stacking station including a plurality of stack-forming assemblies, wherein each stack-forming assembly:

is positioned to receive a respective one of the streams from the third conveyor;

is selectively adjustable to a first configuration in which it is operative to compact the stream into a stack and to eject the stack to a position further downstream, and also adjustable to a second configuration in which it is operative to divert the stream to a fourth conveyor when elements in the stream are determined to be defective; and a stream interrupting mechanism that introduces spacing into each stream to delineate portions of the streams which will form successive stacks, the stream interrupting mechanism being comprised of:

a first adjusting device that is operative to lengthen and shorten a portion of the second conveyor which carries the streams;

a second adjusting device that is operative to lengthen and shorten a portion of the third conveyor which carries the streams, the first and second adjusting devices being operative simultaneously and at the same rate of change, to lengthen the carrying portion of one of the second and third conveyors and to shorten the carrying portion of the other of the second and third conveyors; and a gripping device selectively operable to stop passage of the streams from the second conveyor to the third conveyor, the resulting space introduced between successive elements in the streams serving to delineate the portions of the streams which will form successive stacks; and a drive mechanism for the third conveyor which is operative to move the third conveyor at the same speed as the second conveyor to receive the stream from the second conveyor, and to move the third conveyor faster than the second conveyor when delineated portions of the streams are being delivered to the stacking station.

2. A device according to claim 1, wherein:

the second and third conveyors are respectively comprised of:

belts having slack therein;

drive elements coupled to the respective belts that determine the speeds thereof;

a first plurality of idlers which cooperate with the drive element for the first belt to define the configuration of the first belt; and a second plurality of idlers which cooperate with the drive element for the third belt to define the configuration of the third belt;

a first one of the first plurality of idlers is located at a fixed position relative to the direction of the streams to define the entry point onto the second conveyor from the first conveyor, a second one of the first plurality of idlers is positionable to define a variable exit point from the second conveyor to the third conveyor, a third one of the first plurality of idlers is movable to provide or take up slack in the belt of the second conveyor when the second idler is being positioned;

a first one of the second plurality of idlers is located at a fixed position relative to the direction of the stream to define the exit point from the third conveyor to the stacking station;

a second one of the second plurality of idlers is positionable to define a variable entry point from the second conveyor to the third conveyor, a third one of the second plurality of idlers is movable to provide or take up slack when the second idler is being positioned, the second and third ones of the first plurality of idlers comprise the first adjusting device; and the second and third ones of the second plurality of idlers comprise the second adjusting device.

3. A device according to claim 2, wherein the stream interrupting mechanism includes:

a linearly movable first carriage;

a linearly movable second carriage positioned below the first carriage; and an actuator for the first and second carriages, the actuator being operative to move the carriages simultaneously and at the same speed in opposite directions along axes parallel to the streams.

4. A device according to claim 3, wherein the second ones of the first and second pluralities of idlers are mounted on the first carriage, and the third ones of the first and second pluralities of idlers are mounted on the second carriage.

5. A device according to claim 4, wherein the idlers which are mounted on the second carriage are independently movable relative to the carriage along the axis of movement thereof.

6. A device according to claim 3, wherein the actuator for the first and second carriages includes:

a drive motor;

a rotatable toothed element coupled to the motor; and first and second rack mechanisms respectively coupled to the first and second carriages, the first and second rack mechanisms being positioned to engage the toothed element at respective positions where the tangential velocities of the toothed element are equal and opposite so that rotation of the toothed element causes equal and opposite linear movement of the first and second rack mechanisms.

7. A device according to claim 3, wherein the gripping devices are respectively comprised of:

movable arm assemblies carrying pressure elements positioned in spaced relation to one side of the respective streams; and reaction elements positioned on the opposite sides of the respective streams from the pressure elements to define pinch points with the pressure elements, the arm assemblies each being movable between an idle position at which the pressure elements and the reaction elements are out of contact with the respective streams and an activated position at which the pressure elements and the reaction elements bear against the respective streams and close the pinch points whereby the respective streams are not permitted to pass beyond the pinch points.

8. A device according to claim 7, wherein the pressure elements are mounted on the first carriages.

9. A device according to claim 7, wherein the pressure elements are located below the respective streams, and the reaction elements are vertically aligned with the pressure elements above the respective streams.

10. A device according to claim 1, wherein the gripping devices are respectively comprised of:

movable arm assemblies carrying pressure elements positioned in spaced relation to one side of the respective streams; and reaction elements positioned on the opposite sides of the respective streams from the pressure elements to define pinch points with the pressure elements, the arm assemblies each being movable between an idle position at which the pressure elements and the reaction elements are out of contact with the respective streams and an activated position at which the pressure elements and the reaction elements bear against the respective streams and close the pinch points whereby the respective streams are not permitted to pass beyond the pinch points.

11. A device according to claim 10, wherein the pressure elements are located below the respective streams, and the reaction elements are vertically aligned with the pressure elements above the respective streams.

12. A device according to claim 1, wherein each of the stack-forming assemblies is comprised of a surface which is positioned horizontally in the first configuration to receive the elements exiting the third conveyor thereby to form a stack on the surface, and is positioned sufficiently away from horizontal in the second configuration that the elements exiting the third conveyor fall to the fourth conveyor without contacting the surface.

13. A device according to claim 12, wherein each of the stack-forming assemblies is comprised of an endless belt which defines the surface, and which is selectively movable in the downstream direction to eject the stack.

14. A device according to claim 13, wherein each stack-forming assembly is further comprised of:

an armature which carries a plurality of rollers operative to support the endless belt;

at least one mechanical bearing having first and second rings; and a third ring which is which is mounted on a rotatable shaft and is operative to drive the endless belt, the armature being coupled to the first ring of the mechanical bearing, the second ring of the mechanical bearing being coupled only to the third ring.

15. A device according to claim 1, wherein the stack-forming assemblies respectively include jogging devices in the paths of the respective streams exiting the third conveyor, the jogging devices being operative to arrange the flat elements into piles, the jogging devices being comprised of:

front stop members; and rear stop members located upstream from the front stop members, the front stop members being positionable along the respective streams and transversely to the direction of the streams, the rear stop members being movable transversely to the respective streams.

16. A device according to claim 15, wherein:

the front stop members include faces which are shaped according to the downstream profiles of the elements in the respective streams; and the rear stop members include faces which are shaped according to the upstream profiles of the elements in the respective streams.

17. A device according to claim 16, wherein the jogging devices and a roller defining the downstream end of the third conveyor are coupled together for simultaneous vertical movement upwards while following the height progression of the stacks on the stack forming assemblies, and for vertical movement downwards while stacks are being ejected.

18. A device according to claim 16, wherein the jogging devices are each equipped with a nozzle operative to provide an air blast toward the front stop members at a height below the plane of the carrying surface of the third conveyor belt.

19. A device according to claim 18, wherein the strength of the air blasts, their amount, their position and the orientation of the nozzles constitute adjustable parameters, selected according to the size and weight of the flat elements.

* * * * *